US006041985A

United States Patent [19]

Balser

[11] Patent Number: 6,041,985

[45] Date of Patent: Mar. 28, 2000

[54] MULTIPLE PURPOSE COAT HANGER

[76] Inventor: Glenda C. Balser, 607 E. Church St. (Apt. B), West Unity, Ohio 43570

[21] Appl. No.: 09/364,923

[22] Filed: Aug. 1, 1999

[51] Int. Cl.[7] ..... A41D 27/22

[52] U.S. Cl. ..... 223/91; 223/88; 223/DIG. 4

[58] Field of Search ..... 223/85, 88, 90, 223/91, 93, 92, 96, DIG. 4

[56] References Cited

U.S. PATENT DOCUMENTS

| | | | |
|---|---|---|---|
| 1,990,128 | 2/1935 | Lederer | 223/DIG. 4 |
| 3,041,696 | 7/1962 | Ferri, Jr. | 223/85 |
| 3,100,324 | 8/1963 | Tutino et al. | 223/85 |
| 3,136,019 | 6/1964 | Wolf | 223/DIG. 4 |
| 4,553,294 | 11/1985 | Larsen | 223/85 |
| 5,615,810 | 4/1997 | Kolton et al. | 223/83 |

*Primary Examiner*—Bibhu Mohanty

[57] ABSTRACT

The subject invention is a multiple purpose coat hanger member having additional appendages extending laterally outwardly from the upper neck portion of the hanger from which hanger portions additional articles of clothing can be attached, such lateral extensions comprising a plurality of linear extending members affixed to the neck portion of the hanger, such lateral extension members having attachment means for hanging clothing articles on the extreme end thereof.

4 Claims, 2 Drawing Sheets

MULTIPLE PURPOSE COAT HANGER

DISCUSSION OF PRIOR ART AND BACKGROUND OF INVENTION

The subject invention relates to coat hangers used to hang articles of clothing thereon. Such hanger structures are well known and are generally structured and arranged to hold an article of clothing thereon, such as a coat draped over the shoulder portions of the hanger. Some hangers have additional means to hold a clothing item folded over the bottom rung portion such as trousers, skirts, or the like.

There are no known hanger members adapted to hold several items of clothing thereon with special appendages integrally affixed thereon to hold various additional smaller clothing articles, particularly on the upper portion of the hanger. One of the benefits of having multiple outwardly extending appendages on a hanger is that in addition to the clothing item intended to be worn over the shoulder portions of the hanger, it is desirable to hang thereon additional small clothing items, such as socks, ties, underwear. Such a feature would help place necessary clothing items on the hanger to be ready for dressing as needed.

There are no known clothing hanger structures conceived or in existence that have such additional features, and the subject invention is conceived to provide such features in a single hanger member. Accordingly, the subject invention is conceived and the following objects of the subject invention are directed accordingly.

OBJECTS OF INVENTION

It is an object of the subject invention to provide an improved coat hanger structure;

It is also an object of the subject invention to provide an improved coat hanger structure to accommodate hanging multiple articles of clothing, thereon;

It is another object of the subject invention to provide a coat hanger structure with multiple appendages to hold various clothing articles, such as complete clothing outfits, Still another object of the subject invention is to set forth a multi-purpose clothing hanger;

Yet another object of the subject invention is to set forth an apparatus on which multiple articles of clothing can be loosely draped for ready access;

A further object of the subject invention is to provide an improved hanger member adapted to hold more than two articles of wearing apparel;

Other and further objects of the subject invention will become apparent from a reading of the following description taken in connection with the claims.

DESCRIPTION OF GENERAL EMBODIMENT AND SUMMARY OF INVENTION

Figure 1:
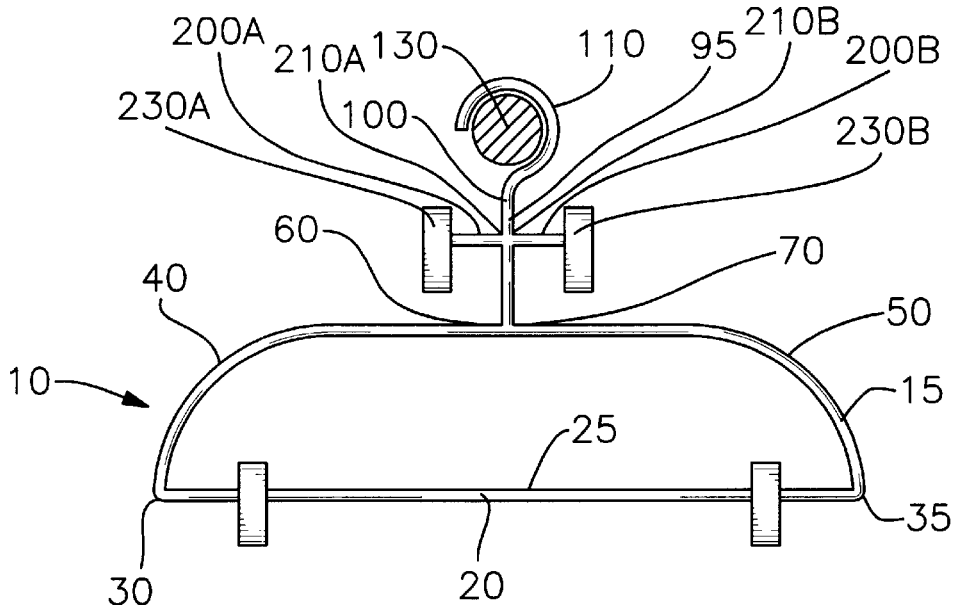
FIG. 1 is a front elevational view of a coat hanger incorporating features of the subject invention.

The subject invention is a multiple purpose coat hanger member having additional appendages extending laterally outwardly from the upper neck portion of the hanger from which hanger portions additional articles of clothing can be attached, such lateral extensions comprising a plurality of linear extending members affixed to the neck portion of the hanger, such lateral extension members having attachment means for hanging clothing articles items on the extreme end thereof.

In summary, the subject invention comprises an improvement to a standardized coat hanger having additional appendages thereon for hanging multiple and differing types of clothing articles, over and above what is usually placed and hung on a conventional hanger. In general, the invention comprises a clothing hanger that is adapted to hold a coat and trousers with additional extending appendages that can be used to additionally hold smaller or miscellaneous clothing items.

DESCRIPTION OF PREFERRED EMBODIMENT

In describing the preferred embodiment of the subject invention, it is to be stressed that the following description is of only one embodiment thereof and that such description shall not be construed as limiting the scope of the invention as set forth in the drawings and claims appended hereto.

Referring now to the drawings, and particularly FIG. 1, shown therein is a coat hanger member 10 having the basic overall structure of a conventionally disposed coat hanger. As seen, such hanger 10 is comprised of a metallic, plastic, or other material which is basically formed of rod-like longitudinally extending components formed as interconnected portions comprising the overall hanger structure. Specifically, as seen in FIG. 1, the hanger 10 forms in its basic structural configuration a truncated triangular member 15, as seen in the frontal elevational view of FIG. 1, with a bottom portion 20, which is generally a straight longitudinally extending member having an upper surface 25 over which can be draped a pair of trouser or other clothing articles. The opposing first end 30 and second end 35 of the bottom portion 20 are joined to a first shoulder portion 40 and a second shoulder portion 50 respectively which shoulder portions extend upwardly in a sloping manner from such respective ends of the bottom portion. The respective upper ends 60 and 70 of each such shoulder portion are joined together at a medial portion 75. As can be seen from the front view of FIG. 1, the bottom portion 20 and the separate shoulder portions of hanger 10 form a truncated triangular configuration where the bottom portion 20 as the base of such triangular form, as viewed from a frontal elevational perspective. The separate shoulder members 40 and 50 form the beginning of upwardly sloping side members of such truncated triangular configuration. Moreover, extending upwardly, from the medial portion 75 of hanger 10, in a vertical and generally straight direction is the neck portion 95 of the hanger. Formed on the upper extremity 100 of the neck portion is a curved hook member 110 that is adapted to be placed conformingly around the upper surface of a supporting bar member 130.

As can be seen from the drawings, and particularly FIG. 1, shown is hanger member 10 incorporating improvement features of the subject invention. As seen in the drawings, hanger 10 is basically formed and structured as described above, with the additional structural additions of a plurality of laterally extending bar members 200A, 200 B, affixed on their respective inner ends 210A and 210B to a portion of the neck portion 95 of the hanger 10. More particularly affixed to the neck portion 95 of the hanger 10 are two laterally extending bar members 200A and 200B, each such bar member having an inner end 210A and 210B, which inner ends are integrally affixed to a portion of the neck portion 95 between the upper end and lower end of the neck portion. In the preferred embodiment of the subject invention, the laterally extending bar members 200 A and 200B project in opposite directions relative to one another from the neck portion 95. This latter opposing direction of the laterally extending bar members 200A and 200B may be varied, however.

Moreover, in the preferred embodiment of the subject invention, the laterally extending bar members 200A and 200B are aligned relative to their respective longitudinal extent parallel to the shoulder portions 40 and 50 of the hanger 10. This latter parallel relationship, while preferred, may be altered and still accomplish the purposes of the invention herein.

In further reference to FIG. 1, it can be seen that the lateral bar members 200A and 200B are provided with perpendicularly extending clasping members 230A and 230B, which clasping members can function as members upon which portions of clothing can be appended or hung for temporary purposes, either by simply draping the clothing article over the end of the respective bar member or by using the clasping member to hold the clothing article. Alternately, at the end of the laterally extending bar members 200A and 200B, and specifically on the outer ends of the perpendicular clasping members may be placed holders or hook members for the holding of the clothing items.

Figure 2:
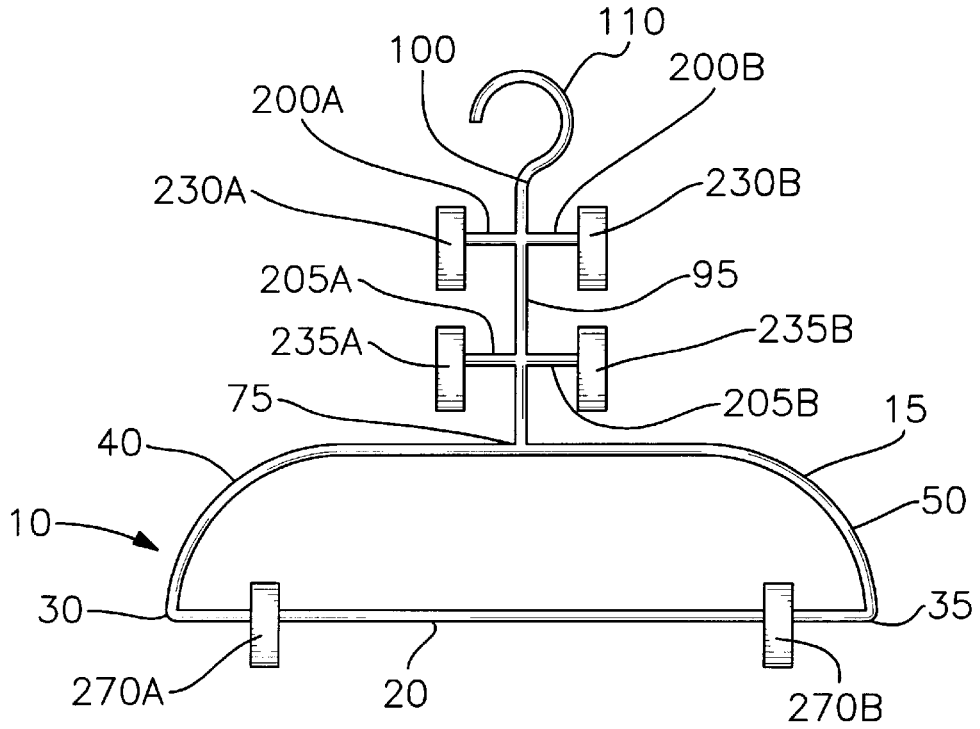
FIG. 2 is a front elevational view of an alternate embodiment of the subject invention.
Figure 3:
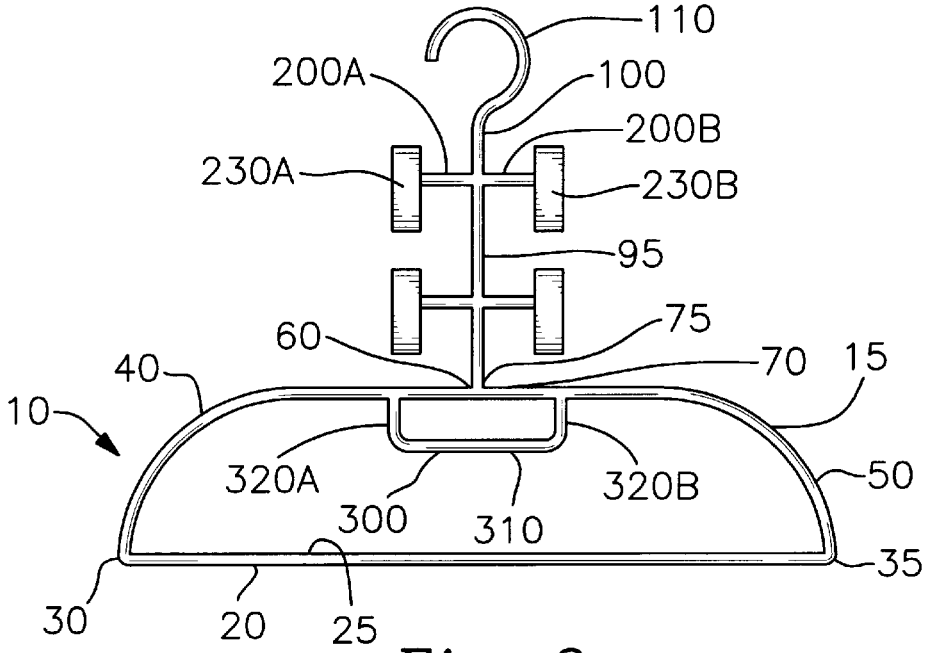
FIG. 3 is a front elevational view of yet another embodiment of the subject invention.
Figure 4:
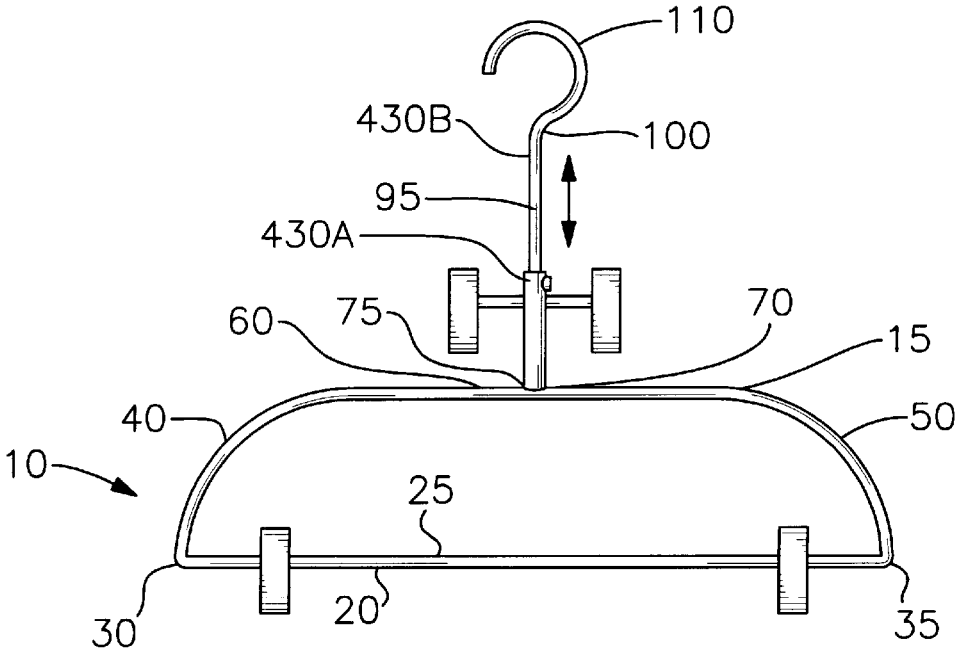
FIG. 4 is a front elevational view of a third alternate embodiment of the subject invention.

Other embodiments of the subject invention, as seen in FIGS. 2, 3 and 4 can be seen additional laterally extending bar members that are added for additional clothing storage capacity. Specifically, in FIG. 2 is shown a hanger member having four laterally extending appendages, 200A, 200B, and 205A and 205B, which appendages having respectively clasping means 230A and 230B and 235A and 235B on the outer ends thereof additionally disposed on the bottom portion of the hanger 10 are additional clothing attachment clothing clasping members 270A and 270B.

The embodiment shown in FIG. 3 is identical to the embodiment shown in FIG. 2 except that the bottom portion 20 does not have clasping means thereon. However, in the embodiment shown in FIG. 3 positioned beneath the medial portion 75 is a holding member 300 having a bar portion 310 connected to vertical support members 320A and 320B which are in turn connected to the hanger 10 just beneath the medial portion 75 and neck portion 100. Bar portion 310 is adapted to hold over the upper surface thereof small clothing items, such as ties.

The embodiment shown in FIG. 4 id identical to that shown in FIG. 1 with the only difference being that the neck portion has two separate sections 430A and 430B, with 430 being a fixed lower portion adapted to receive upper portion 430B in a telescoping manner to adjust the length of the neck portion 95.

I claim:

1. A clothing hanger member comprising:

(a) a base bottom portion;

(b) a shoulder portion having an upper portion and a lower portion, said shoulder portion connected on its lower portion to the base bottom member;

(c) a neck portion having an upper end and a lower end, said neck portions being connected on its lower end to the upper portion of the shoulder portion of said hanger member;

(d) hook means affixed to upper end of the neck portion of said hanger for holding said hanger member from a fixed object;

(e) a plurality of longitudinally extending bar members affixed laterally to the neck portion of said hanger member, said bar members having inner ends and outer ends, with each bar member having means on the outer ends thereof to hold an article of clothing thereon.

2. A clothing hanger member comprising:

(a) a base bottom portion;

(b) a shoulder portion having an upper portion and a lower portion, said shoulder portion connected on its lower portion to the base bottom member;

(c) a neck portion having an upper end and a lower end, said neck portions being connected on its lower end to the upper portion of the shoulder portion of said hanger member;

(d) hook means affixed to upper end of the neck portion of said hanger for holding said hanger member from a fixed object;

(e) a plurality of longitudinally extending bar members affixed laterally to the neck portion of said hanger member, said bar members having inner ends and outer ends, with each bar member having means on the outer ends thereof to hold an article of clothing thereon;

(f) clasping means to hold clothing, said clasping disposed in the bottom portion of said hanger.

3. A clothing hanger member comprising:

(a) a base bottom portion;

(b) a shoulder portion having an upper portion and a lower portion, said shoulder portion connected on its lower portion to the base bottom member;

(c) a neck portion having an upper end and a lower end, said neck portions being connected on its lower end to the upper portion of the shoulder portion of said hanger member;

(d) hook means affixed to upper end of the neck portion of said hanger for holding said hanger member from a fixed object;

(e) a plurality of longitudinally extending bar members affixed laterally to the neck portion of said hanger member, said bar members having inner ends and outer ends, with each bar member having means on the outer ends thereof to hold an article of clothing thereon;

(f) a secondary bar member affixed to the shoulder portion of said hanger member said secondary bar member having means to hold clothing items separately from said base bottom portion.

4. A clothing hanger member comprising:

(a) a base bottom portion;

(b) a shoulder portion having an upper portion and a lower portion, said shoulder portion connected on its lower portion to the base bottom member;

(c) a neck portion having an upper end and a lower end, said neck portions being connected on its lower end to the upper portion of the shoulder portion of said hanger member, said neck portion being formed as a telescoping member adapted to adjust the length of the neck portion;

(d) hook means affixed to upper end of the neck portion of said hanger for holding said hanger member from a fixed object;

(e) a plurality of longitudinally extending bar members affixed laterally to the neck portion of said hanger member, said bar members having inner ends and outer ends, with each bar member having means on the outer ends thereof to hold an article of clothing thereon.

* * * * *